US005951765A

United States Patent [19]

Naujokat

[11] Patent Number: 5,951,765

[45] Date of Patent: Sep. 14, 1999

[54] DEVICE FOR MOVING TRANSVERSE BEAMS FOR TRANSPORTING WORK PIECES TO BE GALVANIZED ALONG SUPPORT RAILS

[75] Inventor: Helmut Naujokat, Bottrop, Germany

[73] Assignee: Balcke Dürr GmbH, Ratingen, Germany

[21] Appl. No.: 08/988,719

[22] Filed: Dec. 11, 1997

[30] Foreign Application Priority Data

Dec. 11, 1996 [DE] Germany ..... 296 21 475 U

[51] Int. Cl.[6] ..... B05C 11/00

[52] U.S. Cl. ..... 118/610; 118/423

[58] Field of Search ..... 118/610, 423, 118/603

[56] References Cited

U.S. PATENT DOCUMENTS 4,256,252 3/1981 Huppunen et al. .

FOREIGN PATENT DOCUMENTS 8184933 12/1981 U.S.S.R. .

*Primary Examiner*—Brenda A. Lamb
*Attorney, Agent, or Firm*—Robert W. Becker & Associates

[57] ABSTRACT

A device for moving transverse beams and workpieces suspended therefrom along a support rail in the longitudinal direction of the support rail. Each one of the transverse beams is connected by lifting devices, for lowering and lifting the workpieces connected to the transverse beam into and out of the zinc bath, to transport carriages riding on the support rail. The transverse beams have a vertically movable doctor blade arrangement at the leading end for removing contaminants from the surface of the zinc bath.

5 Claims, 3 Drawing Sheets

DEVICE FOR MOVING TRANSVERSE BEAMS FOR TRANSPORTING WORK PIECES TO BE GALVANIZED ALONG SUPPORT RAILS

BACKGROUND OF THE INVENTION

The present invention relates to a device for moving transverse beams for transporting workpieces to be galvanized along support rails by a moving device that is comprised of a plurality of transport carriages. The transverse beams are connected to the transport carriages by a lifting device for lifting and lowering the transverse beams and move the workpieces transported thereby into or out of the zinc bath. The workpieces to galvanized are transported in the longitudinal direction of the support rails.

When individual workpieces are to be galvanized, it is necessary, before lowering the work pieces into the zinc bath, to remove contaminants such as cinder remains etc. from the surface of the zinc bath in order to ensure proper galvanization of the workpieces within the zinc bath. In hot galvanizing devices of the prior art the cleaning of the zinc bath surface is performed manually by a rake that is guided by one or two persons along the surface the zinc bath to thereby remove the contaminants. In addition to the work-intensive cleaning operation by the operating personnel of the galvanizing device, in this known cleaning process of the zinc bath surface it is disadvantageous that the transporting device during cleaning of the zinc bath surface by the operating personnel must be shut down so that even for continuously operating devices interruptions are unavoidable.

It is therefore an object of the present invention to embody a device of the aforementioned kind such that downtimes for cleaning the surface of the zinc bath are prevented and the zinc bath surface is automatically cleaned during transport of the transverse beams above the zinc bath without requiring operating personnel.

SUMMARY OF THE INVENTION

The inventive device for moving transverse beams and workpieces suspended therefrom along a support rail in the longitudinal direction of the support rail is characterized in that each one of the transverse beams is connected by a lifting device, for lowering and lifting the workpieces connected to the transverse beams into and out of the zinc bath, to a transport carriage riding on the support rail, wherein the transverse beams comprise of vertically movable doctor blade arrangement at the leading end thereof for removing contaminants of the zinc bath.

Preferably, the doctor blade arrangement, when the transverse beam reaches the zinc bath, is automatically lowered to the surface of the zinc bath.

The doctor blade arrangement comprises a vertically movable, vertically extending shaft connected to the leading end of the transverse beam and further comprises a doctor blade matching the width of the zinc bath. The doctor blade is connected to an end of the shaft facing the zinc bath.

The shaft is preferably a toothed rack driven by a gear wheel.

The doctor blade is a rectangular, flat member comprised of a rigid material.

The doctor blade arrangement at the leading end of the transverse beam, from which the workpieces to be galvanized are suspended, makes it possible to clean without downtimes of the transporting device the zinc bath surface during movement of the transverse beam above the zinc bath surface. In this manner, the workpieces to be galvanized, without downtimes of the transport device, immediately after reaching the end position of the transporting device can be lowered into the zinc bath from which the contaminants have been removed.

According to a preferred embodiment of the invention, the doctor blade arrangement upon reaching the zinc bath can be automatically lowered to the zinc bath level from its rest position. This embodiment of the doctor blade arrangement makes it possible to perform the c leaning of the zinc bath surface automatically so that this embodiment is especially suitable for continuously operating galvanizing devices.

Advantageously, the doctor blade arrangement comprises a substantially vertically extending shaft, i.e., extending perpendicularly to the zinc bath surface, which is vertically movable and is connected to the leading end of the transverse beam. Its end facing the zinc bath has connected thereto a doctor blade that matches the width of the zinc bath. Such an embodiment of the doctor blade arrangement has been proven successful in practice because of its simple and robust design, especially in continuously operating galvanizing devices.

According to a preferred embodiment of the invention, the shaft of the doctor blade arrangement is embodied as a toothed rack that is driven by a gear wheel.

It is furthermore suggested with the present invention that the doctor blade is embodied as a substantially rectangular, flat member comprised of a rigid material.

BRIEF DESCRIPTION OF THE DRAWINGS

The object and advantages of the present invention will appear more clearly from the following specification in conjunction with the accompanying drawings, in which.

DESCRIPTION OF THE PREFERRED EMBODIMENTS

The present invention will now be described in detail with the aid of several specific embodiments utilizing FIGS. 1 to 3.

Figure 1:
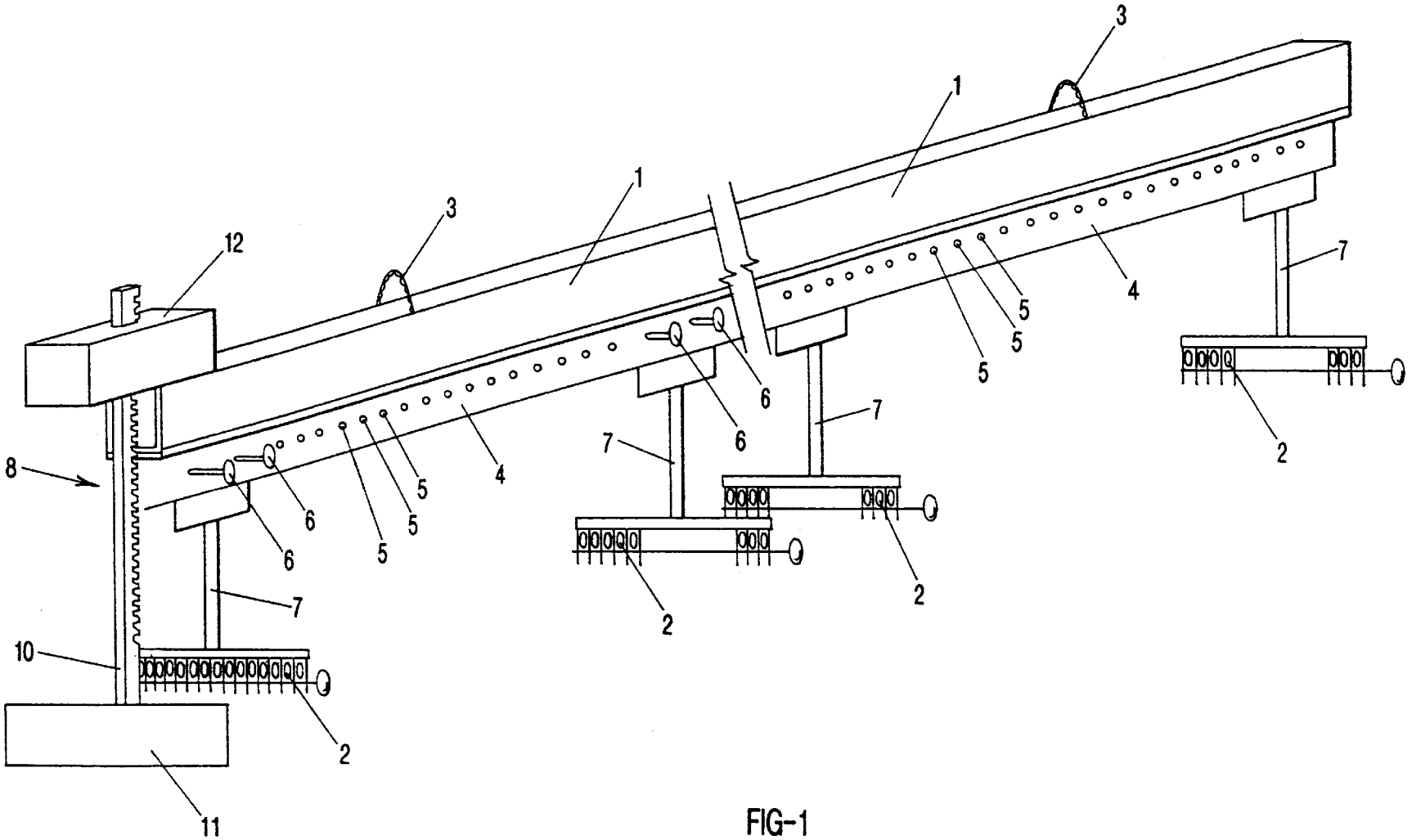
FIG. 1 is a perspective view of a transverse beam with doctor blade arrangement connected to the leading end.
Figure 2:
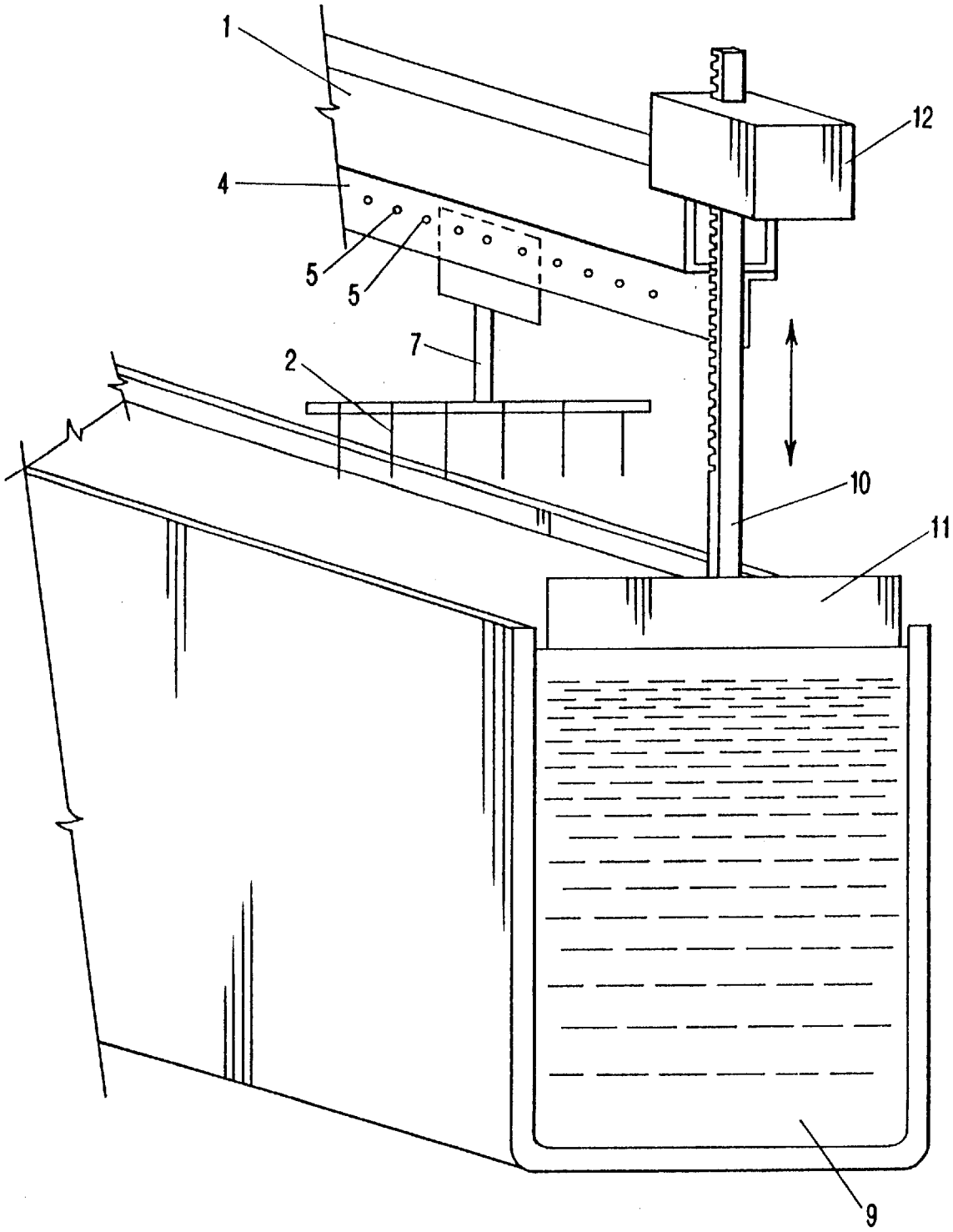
FIG. 2 is a perspective partial view of the galvanizing bath during cleaning of the zinc bath surface by the doctor blade arrangement connected to the transverse beam.

FIG. 1 shows a transverse beam 1 for transporting workpieces to be galvanized. This transverse beam 1 is supported at a support rail SR by transport carriages T moving the transverse beam between various processing stations of a galvanizing device.

Figure 3:
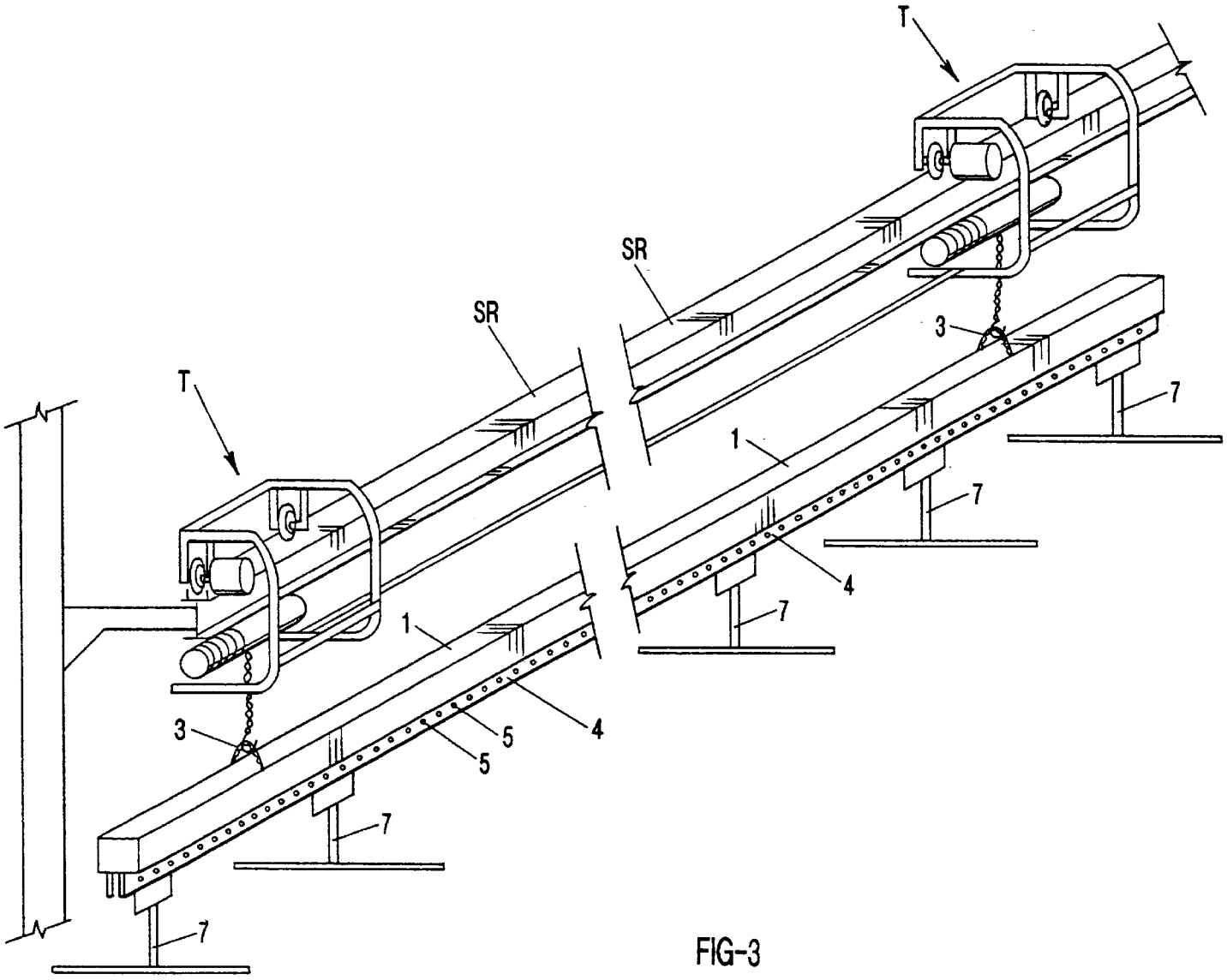
FIG. 3 is a perspective view of the inventive device showing the support rail and transport carriages.

The transverse beam 1 represented in FIG. 1 has at its upper side support eyes 3 for suspending it from the transport carriages T that are movable along the support rails SR (see FIG. 3). For securing the workpieces 2 to be galvanized at the transverse beam 1, the underside of the transverse beam 1 has arranged there at a fastening member 4 that is provided with a plurality of bores 5.

Bolts 6 insertable into the bores 5 secure suspending devices 7 for transporting the workpieces 2 at any selected spacing to one another at the transverse beam.

Especially for transporting elongate pieces of different lengths, for example, heat exchanger tubes, this type of securing at the transverse beam 1 is advantageous because the suspending devices 7 can be connected to the fastening member 4 at any chosen spacing to one another.

At the leading end of the transverse beam 1 a vertically movable doctor blade arrangement 8 is arranged. This doctor blade arrangement, shown in FIG. 2, serves for cleaning the surface of a zinc bath 9 from contaminants such as cinder remains. The doctor blade arrangement 8 is comprised of a shaft 10 which extends perpendicularly to the surface of the zinc bath and which is vertically movable. At the end of the shaft 10 facing the zinc bath 9 a doctor blade 11 is arranged having a width matching the width of the zinc bath 9. In the shown embodiment the shaft 10 is a toothed rack. For vertically moving the doctor blade 8, the leading end of the transverse beam 1 has arranged thereat a drive 12 which comprises, for example, a driven gear wheel which meshes with the shaft 10 embodied as a toothed rack.

The doctor blade arrangement operates as follows.

During movement of the transverse beam 1 with the workpieces 2 arranged thereat between the individual processing stations of a hot galvanizing device, the doctor blade arrangement 8 is in its upper rest position. As soon as the forward end of the transverse beam 1 reaches the zinc bath 9 the doctor blade arrangement 8 is preferably automatically lowered by the drive 12 to such an extent that the doctor blade 11 connected to the lower end of the shaft 10 penetrates into the zinc bath 9 so that the doctor blade 11, upon movement of the transverse beam 1 in the longitudinal direction of the zinc bath 9, pushes contaminants on the surface of the zinc bath 9 forwardly in order to provide thus a zinc bath 9 of free of contaminants into which subsequently the workpieces 2 arranged below the transverse beam can be lowered. After completion of the cleaning process of the zinc bath surface, the doctor blade arrangement 8 is returned into its rest position by the drive 12. In this manner it is possible to automatically clean the surface of a zinc bath 9, i.e., without requiring operating personnel, whereby furthermore no downtimes of the transporting device will occur.

The present invention is, of course, in no way restricted to the specific disclosure of the specification and drawings, but also encompasses any modifications within the scope of the appended claims.

What is claimed is:

1. A device for moving workpieces to and from a zinc bath and lifting and lowering the workpieces out of and into the zinc bath, wherein said device comprises:

transport carriages riding on a support rail in a transport direction and having lifting devices;

transverse beams from which the workpieces are suspended;

said transverse beams connected by said lifting devices to said transport carriages;

wherein each one of said transverse beams comprises a vertically movable doctor blade arrangement at a leading end thereof in said transport direction along the support rail for removing contaminants from surface of the zinc bath.

2. A device according to claim 1, further comprising means for automatically lowering said doctor blade arrangement to the surface of the zinc bath when said transverse beam reaches the zinc bath.

3. A device according to claim 1, wherein said doctor blade arrangement comprises a vertically movable, vertically extending shaft connected to said leading end of said transverse beam and further comprises a doctor blade matching a width of the zinc bath, wherein said doctor blade is connected to an end of said shaft facing the zinc bath.

4. A device according to claim 3, wherein said shaft is a toothed rack driven by a gear wheel.

5. A device according to claim 3, wherein said doctor blade is a rectangular, flat member comprised of a rigid material.

* * * * *